US006400387B1

(12) United States Patent
Kerr

(10) Patent No.: US 6,400,387 B1
(45) Date of Patent: Jun. 4, 2002

(54) LATHE BED SCANNING ENGINE WITH ADJUSTABLE BEARING RODS MOUNTED THEREIN

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/644,729

(22) Filed: Aug. 23, 2000

(51) Int. Cl.[7] ..... B41J 25/304
(52) U.S. Cl. ..... 347/198
(58) Field of Search ..... 347/198, 197, 347/262, 138, 140; 324/662; 358/476

(56) References Cited

U.S. PATENT DOCUMENTS 3,869,569 A * 3/1975 Mason et al. ..... 358/476
5,070,302 A * 12/1991 Marcus et al. ..... 324/662
5,268,708 A 12/1993 Harshbarger et al.
5,276,464 A 1/1994 Kerr et al.
5,777,658 A 7/1998 Kerr et al.
5,909,327 A * 6/1999 Kerr et al. ..... 347/262
6,002,419 A 12/1999 Kerr et al.
6,014,162 A 1/2000 Kerr et al.
6,037,960 A 3/2000 Kerr et al.
6,249,300 B1 * 6/2001 Kerr et al. ..... 347/197

OTHER PUBLICATIONS

Kerr, "A Print Engine Chassis Having Adjustable Sidewall Thickness", USSN 09/499,813, (80296/NAB), Filed Feb. 8, 2000.

* cited by examiner

*Primary Examiner*—John Barlow
*Assistant Examiner*—K. Feggins
(74) *Attorney, Agent, or Firm*—Harleston Law Firm

(57) ABSTRACT

This image forming apparatus (10) for sheet print media includes an imaging drum (300) for holding print media (32) and colorant donor sheet material (36) in registration on the imaging drum (300). A printhead (500) moves along a line parallel to the longitudinal axis of the imaging drum (300) as the imaging drum (300) rotates. The printhead (500) receives information signals and produces radiation which is directed to the colorant donor sheet material (36) to the print media (32). A linear translation subsystem (240) for moving the printhead (500) has at least one translation bearing rod (206/208) that is adjustable to minimize misalignment error between the linear translation subsystem (240) and the imaging drum (300).

25 Claims, 10 Drawing Sheets

LATHE BED SCANNING ENGINE WITH ADJUSTABLE BEARING RODS MOUNTED THEREIN

FIELD OF THE INVENTION

This invention relates to a linear translation subsystem of an image-forming apparatus of the lathe bed scanning type for creating an image on sheet media held on a rotating imaging drum, and more particularly to the alignment of the translation bearing rod or rods to the imaging drum surface.

BACKGROUND OF THE INVENTION

Pre-press color proofing is a procedure that is used by the printing industry for creating representative images of printed material without the high cost and time that is required to actually produce printing plates and set up a highspeed, high-volume printing press to produce an example single of an intended image. These intended images may require several corrections and be reproduced several times to satisfy customers requirements, which results in loss of profits. By utilizing pre-press color proofing, time and money can be saved.

One such commercially available image-forming apparatus, which is depicted in commonly assigned U.S. Pat. No. 5,268,708, is an image forming apparatus having half-tone color proofing capabilities. This image forming apparatus is arranged to form an intended image on a sheet of thermal print media by transferring colorant from a sheet of colorant donor material to the thermal print media by applying a sufficient amount of thermal energy to the colorant donor material to form an intended image. This image forming apparatus is comprised generally of a material supply assembly or carousel; lathe bed scanning subsystem, which includes a lathe bed scanning support frame, translation drive, translation stage member, printhead, and imaging drum; and thermal print media and colorant donor material exit transports.

The operation of the image-forming apparatus includes metering a length of the thermal print media (in roll form) from the material assembly or carousel. The thermal print media is then measured and cut into sheet form of the required length and transported to the imaging drum, registered, wrapped around, and secured onto the imaging drum. Next, a length of colorant donor material (in roll form) is also metered out of the material supply assembly or carousel, then measured and cut into sheet form of the required length. It is then transported to and wrapped around the imaging drum, such that it is superposed in the desired registration with respect to the thermal print media (which has already been secured to the imaging drum). A rotatable vacuum imaging drum is preferred herein.

After the colorant donor material is secured to the periphery of the imaging drum, the scanning subsystem or write engine provides the scanning function. This is accomplished by retaining the thermal print media and the colorant donor material on the spinning vacuum imaging drum while it is rotated past the printhead that will expose the thermal print media. The translation drive then traverses the printhead and translation stage member axially along the vacuum imaging drum, in coordinated motion with the rotating vacuum imaging drum. These movements combine to produce the intended image on the thermal print media.

After the intended image has been written on the thermal print media, the colorant donor material is then removed from the vacuum imaging drum. This is done without disturbing the thermal print media that is beneath it. The colorant donor material is then transported out of the image forming apparatus by the colorant donor material exit transport. Additional colorant donor materials are sequentially superposed with the thermal print media on the vacuum imaging drum. Then they are imaged onto the thermal print media as previously mentioned, until the intended image is completed. The completed image on the thermal print media is then unloaded from the vacuum imaging drum and transported to an external holding tray on the image forming apparatus by the receiver sheet material exit transport.

The material supply assembly comprises a carousel assembly mounted for rotation about its horizontal axis on bearings at the upper ends of vertical supports. The carousel comprises a vertical circular plate having in this case six (but not limited to six) material support spindles. These support spindles are arranged to carry one roll of thermal print media, and four rolls of colorant donor material to provide the four primary colors used in the writing process to form the intended image, and one roll as a spare or for a specialty color colorant donor material (if so desired). Each spindle has a feeder assembly to withdraw the thermal print media or colorant donor material from the spindles, which is to be cut into a sheet form. The carousel is rotated about its axis into the desired position, so that the thermal print media or colorant donor material (in roll form) can be withdrawn, measured, and cut into sheet form of the required length, and then transported to the vacuum imaging drum.

The scanning subsystem or write engine of the lathe bed scanning type comprises the mechanism that provides the mechanical actuators, for the vacuum imaging drum positioning and motion control to facilitate placement, loading onto, and removal of the thermal print media and the colorant donor material from the vacuum imaging drum. The scanning subsystem or write engine provides the scanning function by retaining the thermal print media and colorant donor material on the rotating vacuum imaging drum, which generates a once per revolution timing signal to the data path electronics as a clock signal while the translation drive traverses the translation stage member and printhead axially along the vacuum imaging drum in a coordinated motion with the vacuum imaging drum rotating past the printhead. This is done, with positional accuracy maintained, to allow precise control of the placement of each pixel in order to produce the intended image on the thermal print media.

The lathe bed scanning frame provides the structure to support the linear translation subsystem, printhead, and the imaging drum and its rotational drive. The translation stage member and printhead are supported by two translation bearing rods that are ideally straight along their longitudinal axis. This permits low friction movement of the translation stage member and the translation drive. The translation bearing rods are positioned and supported at their ends by bores in the outside walls of the lathe bed scanning support frame or write engine.

The two translation bearing rods are arranged between the translation stage member and the printhead. A front translation bearing rod is arranged to locate the axis of the printhead precisely on the axis of the imaging drum with the axis of the printhead located perpendicular, vertical, and horizontal to the axis of the imaging drum. The translation stage member front bearing is arranged to form an inverted "V" and provides only that constraint to the translation stage member. The translation stage member is held in place by its own weight. The rear translation bearing rod locates the translation stage member with respect to rotation of the translation stage member about the axis of the front translation bearing rod. This is done so that no over constraint of the translation stage member causes it to bind, chatter, or otherwise impart undesirable vibration to the translation drive or printhead during the writing process. Such vibrations can cause unacceptable artifacts in the intended image. The rear bearing enables this advantage by engaging the rear translation bearing rod only on diametrically opposite side of the translation bearing rod on a line perpendicular to a line connecting the centerlines of the front and rear translation bearing rods.

Although currently available image forming apparatus are satisfactory, they do have certain drawbacks. First, alignment of the linear translation subsystem limits the output quality that the intended image can be exposed onto the thermal print media within the intended image, intended image to intended image within a given image forming apparatus, or intended image to intended image, from one image forming apparatus to another image forming apparatus. More importantly, the same is true of the alignment of the printhead to the imaging drum surface or the thermal print media and colorant donor material. With existing image forming apparatus, alignment of the linear translation subsystem, and the printhead relative to the imaging drum surface or the thermal print media and colorant donor material, is limited by the constraints imposed by the accuracy of currently available manufacturing technology to produce the lathe bed scanning engine.

The present invention has several advantages. First, the present invention provides an increase in image quality of the intended image, intended image to intended image, and the intended image from image forming apparatus to image forming apparatus. Second, the need to automatically focus the printhead is reduced or eliminated by improved alignment of the linear translation subsystem and printhead to the imaging drum surface, and also the thermal print media, and colorant donor material. Third, the linear translation subsystem is aligned, as is the printhead to the imaging drum surface, thermal print media and colorant donor material. This considerably reduces required maintenance, costs, and complexity of the image forming apparatus. Finally, the present invention provides an added margin for depth of focus, and for handling a larger range of media thickness tolerance.

In general, currently available image forming apparatus have fixed translation bearing rods. The linear translation subsystem is therefore fixed and relies upon the accuracy of currently available manufacturing tolerances. Among other things, the present invention reduces or eliminates reliance upon manufacturing tolerances by employing adjustable and lockable translation bearing rods.

SUMMARY OF THE INVENTION

According to one aspect of the present invention, this invention is an image forming apparatus for writing images to a thermal print media, comprising:

a) a rotatable imaging drum comprising a drum housing;

b) a motor capable of rotating the imaging drum;

c) print media mounted on the imaging drum;

d) a printhead adapted for forming the intended image, the printhead being movable along a line parallel to a longitudinal axis of said imaging drum as the imaging drum rotates; and e) a linear translation subsystem for moving the printhead, the linear translation subsystem including one or two adjustable translation bearing rods, which are parallel to the longitudinal axis of the imaging drum. The printhead is supported on the translation bearing rod, and the translation bearing rod is adjustable for minimizing misalignment error between the linear translation subsystem and the imaging drum.

The present invention also includes a process for minimizing misalignment of a linear translation subsystem of an image forming apparatus, comprising the following steps:

a) temporarily replacing a printhead with a capacitance probe mounted in a probe holder;

b) mounting sheet print media and colorant donor material on an imaging drum;

c) rotating the imaging drum at writing speed;

d) allowing a linear translation subsystem to move a translation stage along the imaging drum;

e) using the capacitance probe to measure a distance, or gap, between the capacitance probe and the surface of the imaging drum;

f) adjusting any misalignment of the linear translation subsystem to the imaging drum surface;

g) locking the translation bearing rods in place;

h) removing the capacitance probe; and i) reinstalling the printhead.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
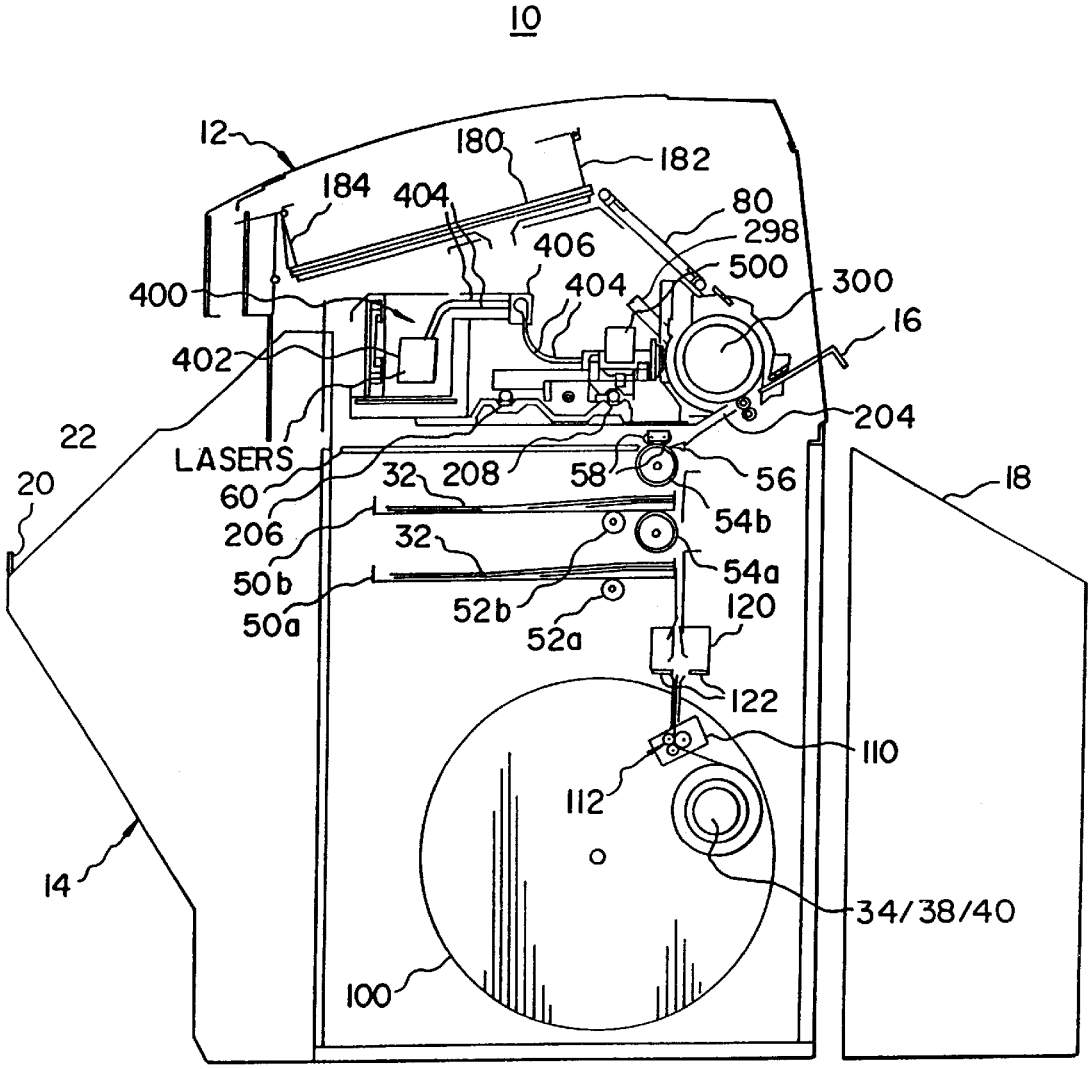
FIG. 1 is an elevational view in vertical cross section of an image forming apparatus of the present invention.

Referring to FIG. 1, there is illustrated an image forming apparatus 10 according to the present invention having an image processor housing 12, which provides a protective cover. A movable, hinged image processor door 14 is attached to the front portion of the image processor housing 12 permitting access to the two sheet material trays, lower sheet material tray 50*a* and upper sheet material tray 50*b*, that are positioned in the interior portion of the image processor housing 12 for supporting sheet print media 32 thereon. Only one of the sheet material trays 50 will dispense the sheet print media 32 out of its sheet material tray 50 to create an intended image thereon; the alternate sheet material tray either holds an alternative type of sheet print media 32 or functions as a back up sheet material tray. In this regard, the lower sheet material tray 50*a* includes a lower media lift cam 52*a* for lifting the lower sheet material tray 50*a* and ultimately the thermal print media 32, upwardly toward a rotatable, lower media roller 54*a* and toward a second rotatable, upper media roller 54*b* which, when both are rotated, permits the thermal print media 32 to be pulled upwardly towards a media guide 56. The upper sheet material tray 50*b* includes a upper media lift cam 52*b* for lifting the upper sheet material tray 50*b* and ultimately the thermal print media 32 towards the upper media roller 54*b*, which directs it towards the media guide 56.

The movable media guide 56 directs the thermal print media 32 under a pair of media guide rollers 58, which engages the thermal print media 32 for assisting the upper media roller 54*b* in directing it onto the media staging tray 60. The media guide 56 is attached and hinged to the lathe bed scanning frame 202 at one end, and is uninhibited at its other end for permitting multiple positioning of the media guide 56. The media guide 56 then rotates its uninhibited end downwardly, as illustrated in the position shown, and the direction of rotation of the upper media roller 54*b* is reversed for moving the thermal print medium receiver sheet material 32 resting on the media staging tray 60 under the pair of media guide rollers 58, upwardly through an entrance passageway 204 and around a rotatable vacuum imaging drum 300.

Continuing with FIG. 1, a roll 30 of colorant donor material 34 is connected to the media carousel 100 in a lower portion of the image processor housing 12. Four rolls 30 are used, but only one is shown for clarity. Each roll 30 includes a colorant donor material 34 of a different color, typically black, yellow, magenta and cyan. These colorant donor materials 34 are ultimately cut into colorant donor materials 36 and passed to the vacuum imaging drum 300 for forming the medium from which colorants imbedded therein are passed to the thermal print media 32 resting thereon, which process is described in detail herein below. In this regard, a media drive mechanism 110 is attached to each roll 30 of colorant donor material 34, and includes three media drive rollers 112 through which the colorant donor material 34 of interest is metered upwardly into a media knife assembly 120. After the colorant donor material 34 reaches a predetermined position, the media drive rollers 112 cease driving the colorant donor material 34 and the two media knife blades 122 positioned at the bottom portion of the media knife assembly 120 cut the colorant donor material 34 into colorant donor sheet materials 36. The lower media roller 54*a* and the upper media roller 54*b* along with the media guide 56 then pass the colorant donor sheet material 36 onto the media staging tray 60 and ultimately to the vacuum imaging drum 300 and in registration with the thermal print media 32 using the same process as described above for passing the thermal print media 32 onto the imaging drum 300. The colorant donor sheet material 36 now rests atop the thermal print media 32 with a narrow gap between the two created by microbeads imbedded in the surface of the thermal print media 32.

A laser assembly 400 includes several lasers 402. Laser diodes within the laser assembly are connected via fiber-optic cables 404 to a distribution block 406 and ultimately to the printhead 500. They can be individually modulated to supply energy to selected areas of the thermal print media in accordance with an information signal. The printhead 500 includes a plurality of optical fibers coupled to the laser diodes at one end and at and opposite end to a fiber-optic array within the printhead. The printhead is movable relative to the longitudinal axis of the imaging drum. The printhead 500 directs thermal energy received from the lasers, causing the colorant donor sheet material 36 to pass the desired color across the gap to the thermal print media 32. The printhead 500 is attached to a lead screw 250 via the lead screw drive nut 254 and drive coupling 256 (not shown in FIG. 1) for permitting movement axially along the longitudinal axis of the imaging drum 300 for transferring the data to create the intended image onto the thermal print media 32. A vacuum imaging drum is shown.

For writing, the imaging drum 300 rotates at a constant velocity, and the printhead 500 begins at one end of the thermal print media 32 and traverses the entire length of the thermal print media 32 for completing the transfer process for the particular colorant donor sheet material 36 resting on the thermal print media 32. After the printhead 500 has completed the transfer process for the particular colorant donor sheet material 36 resting on the thermal print media 32, the colorant donor sheet material 36 is then removed from the imaging drum 300 and transferred out the image processor housing 12 via a skive or ejection chute 16. The colorant donor sheet material 36 eventually comes to rest in a waste bin 18 for removal by the user. The above described process is then repeated for the other three rolls 30 of colorant donor materials 34.

After the color from all four sheets of the colorant donor materials 36 has been transferred and the colorant donor materials 36 have been removed from the vacuum imaging drum 300, the thermal print media 32 is removed from the vacuum imaging drum 300 and transported via a transport mechanism 80 to a color binding assembly 180. The entrance door 182 of the color binding assembly 180 is opened for permitting the thermal print media 32 to enter the color binding assembly 180, and shuts once the thermal print media 32 comes to rest in the color binding assembly 180. The color binding assembly 180 processes the thermal print media 32 for further binding the transferred colors on the thermal print media 32 and for sealing the microbeads thereon. After the color binding process has been completed, the media exit door 184 is opened and the thermal print media 32 with the intended image thereon passes out of the color binding assembly 180 and the image processor housing 12 and comes to rest against a media stop 20.

Figure 2:
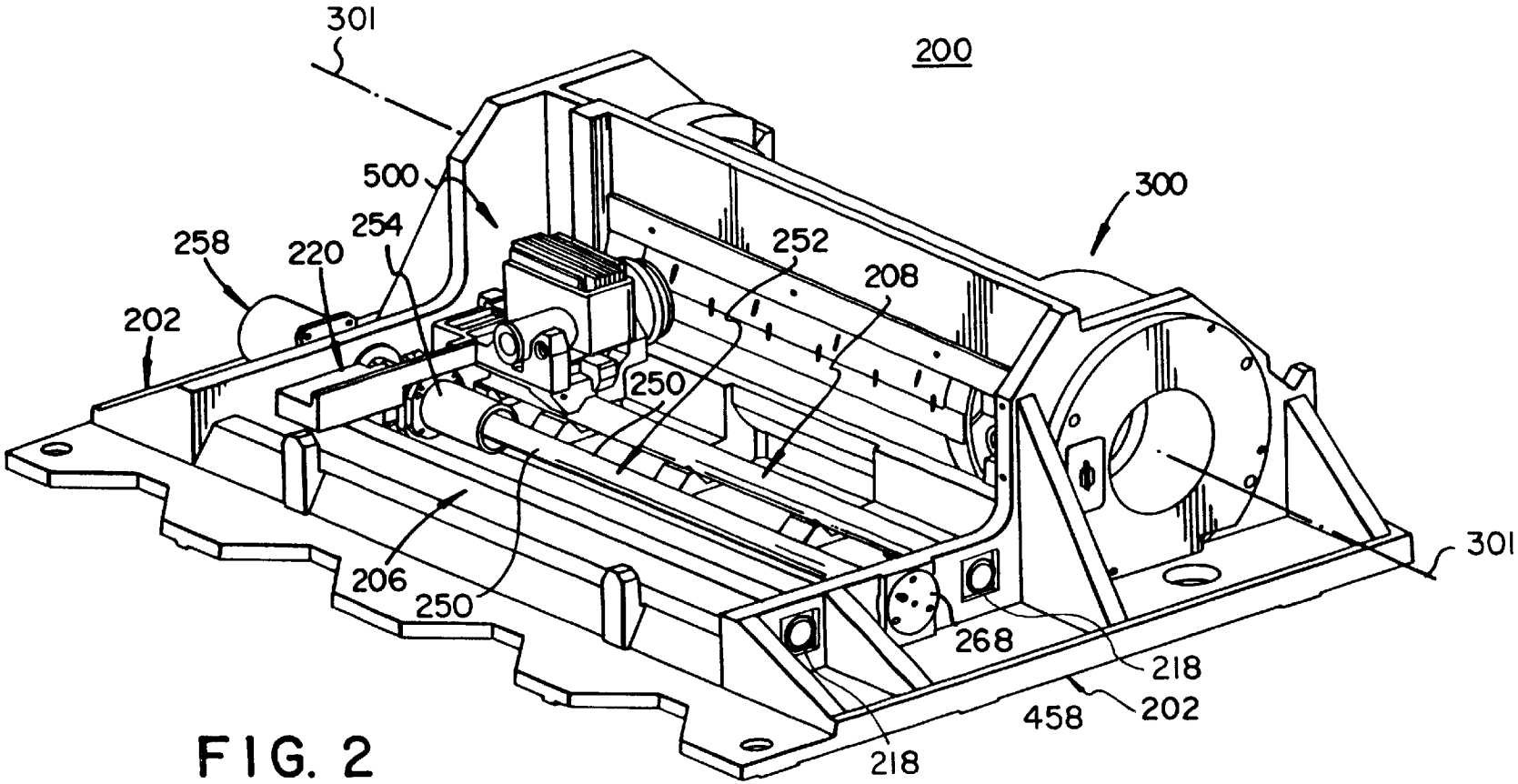
FIG. 2 shows a perspective view of a lathe bed scanning subsystem, or write engine, of the present invention.

Referring to FIG. 2, there is illustrated a perspective view of the lathe bed scanning subsystem 200 of the image forming apparatus 10, including the imaging drum 300, printhead 500 and lead screw 250 assembled in the lathe bed scanning frame 202. The imaging drum 300 is mounted for rotation about an axis X in the lathe bed scanning frame 202. In the preferred embodiment shown, the translation bearing rods 206, 208 are arranged parallel with axis X of the imaging drum 300, with the axis of the printhead 500 perpendicular to the axis X of the imaging drum 300. The printhead 500 is movable with respect to the imaging drum 300, and is arranged to direct a beam of light to the colorant donor sheet material 36. The beam of light from the printhead 500 for each laser 402 is modulated individually by modulated electronic signals from the image forming apparatus 10, which are representative of the shape and color of the original image, so that the color on the colorant donor sheet material 36 is heated to cause volatilization only in those areas in which its presence is required on the thermal print media 32 to reconstruct the shape and color of the original image.

The printhead 500 is mounted on a movable translation stage member 220 which, in turn, is supported for low friction slidable movement on translation bearing rods 206 and 208. The front translation bearing rod 208 locates the translation stage member 220 in the vertical and the horizontal directions with respect to axis X of the vacuum imaging drum 300. The rear translation bearing rod 206 locates the translation stage member 220 only with respect to rotation of the translation stage member 220 about the front translation bearing rod 208, so that there is no overconstraint condition of the translation stage member 220 which might cause it to bind, chatter, or otherwise impart undesirable vibration to the printhead 500 during the generation of an intended image.

Continuing with FIG. 2, the translation bearing rods 206, 208 are positioned and supported at their ends by rod support bores 218 in the outside walls 458 of the lathe bed scanning frame 202. Each rod support bore supports an end of a translation bearing rod. The rod support bores 218 are machined into the walls of the lathe bed scanning support frame 202 to allow adjustment of the translation bearing rods 206 and 208. The rod support bores 218 may comprise notches in an appropriate direction at one or both ends of the translation bearing rod. The notches are adapted for allowing adjustment of the translation bearing rods to compensate for manufacturing defects in the translation bearing rod.

Figure 3:
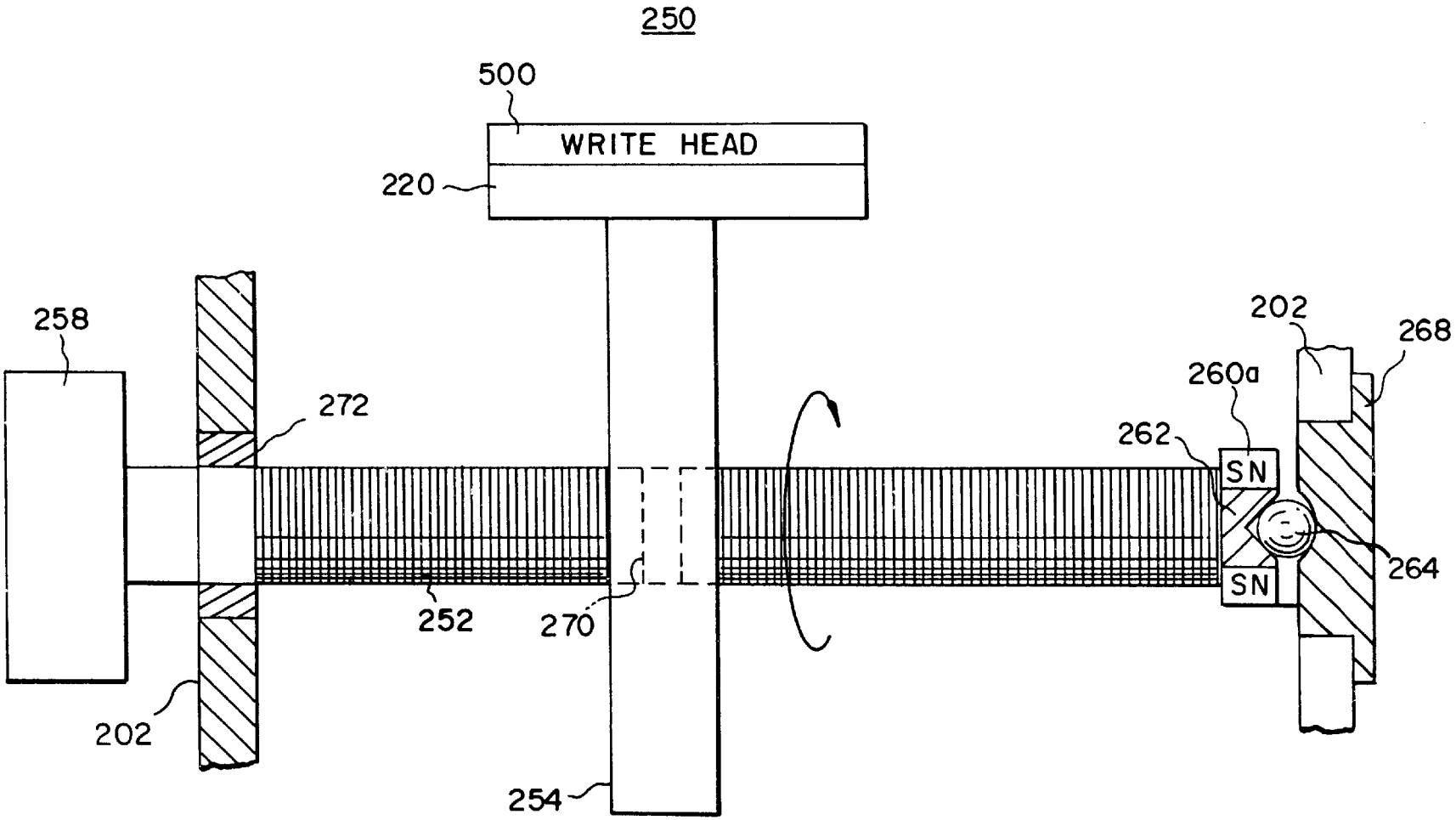
FIG. 3 is a plan view in horizontal cross section, partially in phantom, of a lead screw of the present invention.

Referring to FIGS. 2 and 3, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion 270 for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the to the printhead 500 through the lead screw coupling 256 (not shown) and the translation stage member 220 at its periphery so that as the threaded shaft 252 is rotated by the linear drive motor 258 the lead screw drive nut 254 moves axially along the threaded shaft 252 which in turn moves the translation stage member 220 and ultimately the printhead 500 axially along the vacuum imaging drum 300.

As illustrated in FIG. 3, an annular- shaped axial load magnet 260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodyrnium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular shaped insert 266 is placed in the hollowed-out portion of the other annular shaped axial load magnet 260*b*, and includes an accurate-shaped surface on one end for receiving the ball bearing 264, and a flat surface at its other end for receiving an end cap 268 placed over the annular-shaped axial load magnet 260b and attached to the lathe bed scanning frame 202 for protectively covering the annular-shaped axial load magnet 260*b* and providing an axial stop for the lead screw 250.

The lead screw 250 operates as follows. The linear drive motor 258 is energized and imparts rotation to the lead screw 250, as indicated by the arrows, causing the lead screw drive nut 254 to move axially along the threaded shaft 252. The annular-shaped axial load magnets 260*a* and 260*b* are magnetically attracted to each other, which prevents axial movement of the lead screw 250.

The ball bearing 264, however, permits rotation of the lead screw 250 while maintaining the positional relationship of the annular-shaped axial load magnets 260. The annular-shaped axial load magnets 260 are slightly spaced apart, which prevents mechanical friction between them while obviously permitting the threaded shaft 252 to rotate.

The printhead 500 travels in a path along the imaging drum 300, while being moved at a speed synchronous with the imaging drum 300 rotation and proportional to the width of the writing swath 450 (not shown). The pattern that the printhead 500 transfers to the thermal print media 32 along the imaging drum 300 is a helix.

Figure 4:
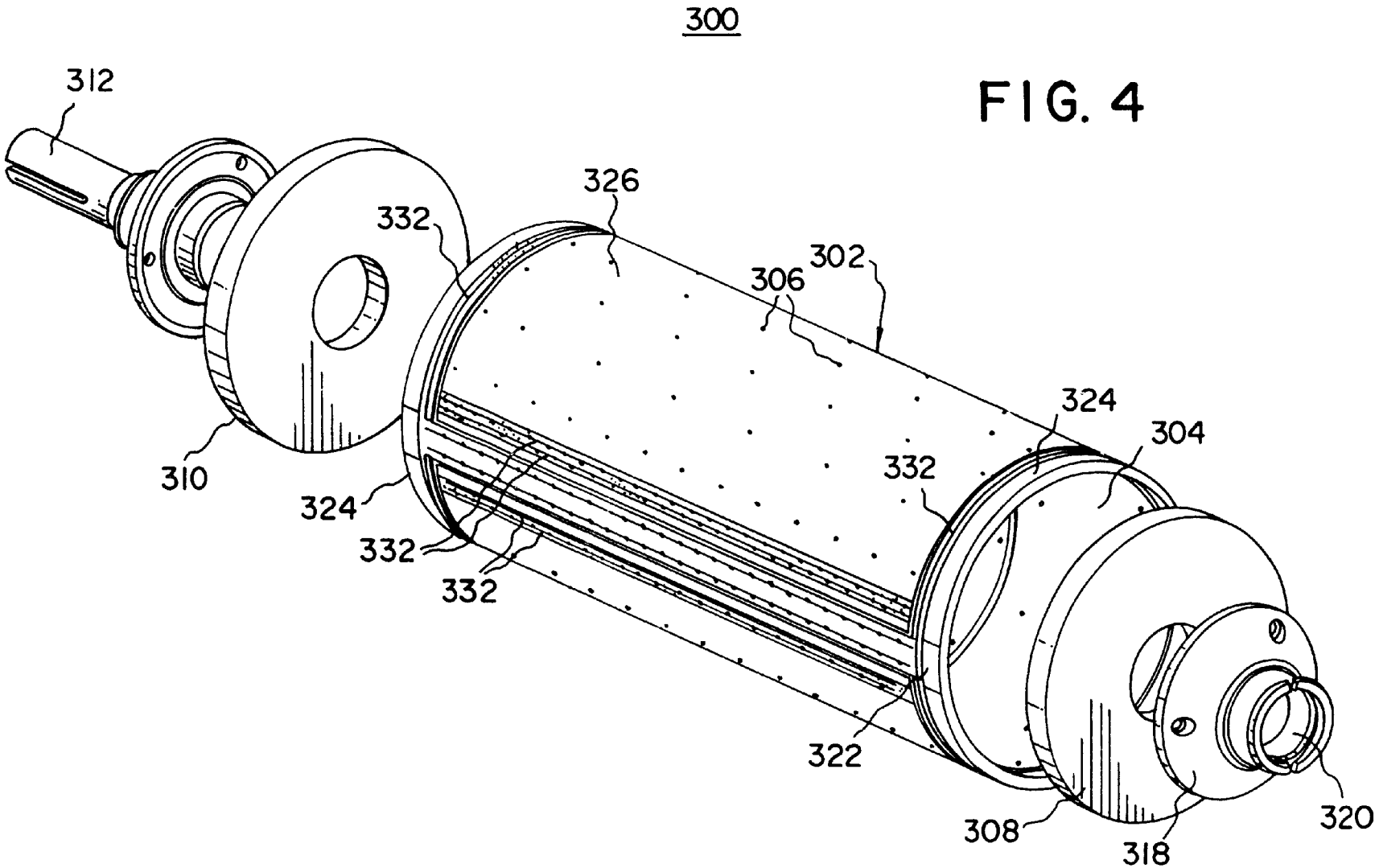
FIG. 4 is an exploded, perspective view of a vacuum imaging drum of the present invention.

Referring to FIG. 4, an exploded view of the vacuum imaging drum 300 is illustrated. The vacuum imaging drum 300 comprises a generally cylindrically shaped vacuum drum housing 302 with a hollowed-out interior portion 304. The vacuum imaging drum 300 also includes a plurality of vacuum grooves 332 and vacuum holes 306. These extend through the vacuum drum housing 302 and allow a vacuum to be applied from the hollowed-out interior portion 304 of the vacuum imaging drum 300 for supporting and maintaining position of the thermal print media 32 and the colorant donor sheet material 36 as the vacuum imaging drum 300 rotates.

The ends of the vacuum imaging drum 300 are closed by the vacuum end plate 308 and the drive end plate 310. The drive end plate 310 has a centrally disposed drive spindle 312, which extends outwardly therefrom through a support bearing 314. The vacuum end plate 308 is provided with a centrally disposed vacuum spindle 318, which extends outwardly therefrom through another support bearing 314.

The drive spindle 312 extends through the support bearing 314 and is stepped down to receive a DC drive motor armature (not shown), which is held on by means of a drive nut (not shown). A DC motor stator is stationarily held by the late scanning bed frame member, encircling the DC drive motor armature to form a reversible, variable DC drive motor for the vacuum imaging drum 300. At the end of the drive spindle 312, a drum encoder (not shown) is mounted to provide timing signals to the image forming apparatus 10.

The vacuum spindle 318 is provided with a central vacuum opening 320, which is in alignment with a vacuum fitting 222 with an external flange that is rigidly mounted to the lathe bed scanning frame 202. The vacuum fitting 222 has an extension which extends within but is closely spaced from the vacuum spindle 318, thus forming a small clearance. With this configuration, a slight vacuum leak is provided between the outer diameter of the vacuum fitting 222 and the inner diameter of the central vacuum opening 320 of the vacuum spindle 318. This assures that no contact exists between the vacuum fitting 222 and the vacuum imaging drum 300 which might cause the vacuum imaging drum 300 to vibrate unevenly during its rotation. The opposite end of the vacuum fitting 222 is connected to a high-volume vacuum blower 224 which is capable of producing 50–60 inches of water (93.5–112.2 mm of mercury) at an air flow volume of 60–70 cfm (28.368–33.096 liters per second).

The vacuum blower provides vacuum to the vacuum imaging drum 300 and supports the various internal vacuum levels of the vacuum imaging drum 300 required during the loading, scanning and unloading of the thermal print media 32 and the colorant donor materials 36 to create the intended image. With no media loaded on the vacuum imaging drum 300 in this preferred embodiment, the internal vacuum level of the vacuum imaging drum 300 is approximately 10–15 inches of water (18.7–28.05 millimeters of mercury). With just the thermal print media 32 loaded on the vacuum imaging drum 300, the internal vacuum level of the vacuum imaging drum 300 is approximately 20–25 inches of water (37.4–46.75 millimeters of mercury). This level is required so that when a colorant donor sheet material 36 is removed, the thermal print media 32 does not move. Otherwise, color to color registration will not be maintained. With both the thermal print media 32 and colorant donor sheet material 36 completely loaded on the vacuum imaging drum 300, the internal vacuum level of the vacuum imaging drum 300 in this preferred configuration is approximately 50–60 inches of water (93.5–112.2 millimeters of mercury).

Figure 5:
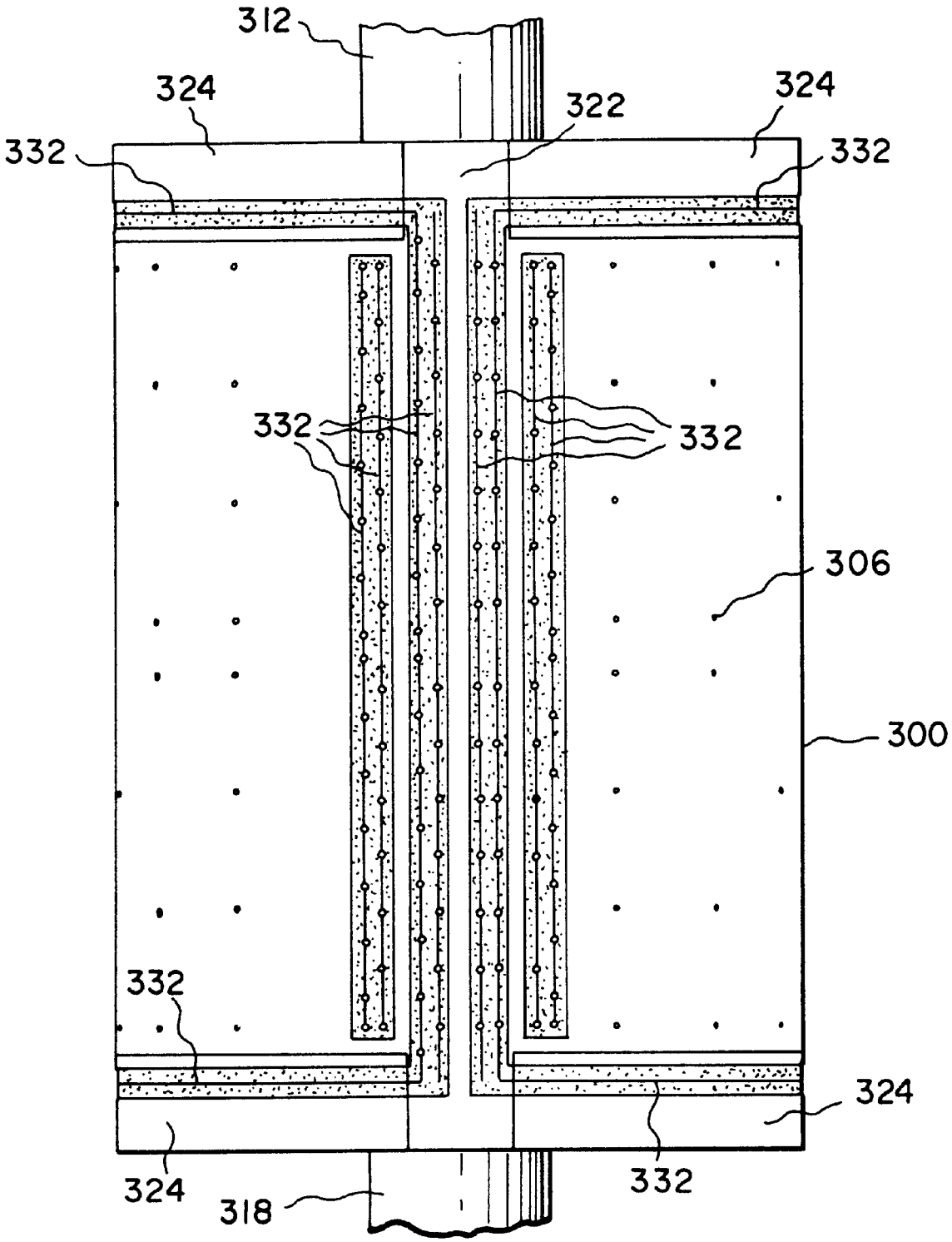
FIG. 5 shows a plan view of a vacuum imaging drum surface of the present invention.

As shown in FIG. 5, the outer surface of the vacuum imaging drum 300 is provided with an axially extending flat 322, which extends approximately 8 degrees of the vacuum imaging drum 300 circumference. The vacuum imaging drum 300 is also provided with donor support rings 324 which form a circumferential recess 326 extending circumferentially from one side of the axially extending flat 322 circumferentially around the vacuum imaging drum 300 to the other side of the axially extending flat 322, and from approximately one inch (25.4 millimeters) from one end of the vacuum imaging drum 300 to approximately one inch (25.4 millimeters) from the other end of the vacuum imaging drum 300.

The vacuum imaging drum axially extending flat 322 serves a two fold purpose. First, it assures that the leading and trailing ends of the colorant donor material 36 are somewhat protected from air turbulence during the relatively high speed rotation that a vacuum imaging drum 300 undergoes during the imaging process. The leading or trailing edges of the colorant donor material are therefore less likely to lift. The vacuum imaging drum axially extending flat 322 also ensures that the leading and trailing ends of the colorant donor material 36 are recessed from the vacuum imaging drum 300 periphery. This reduces the chances that the colorant donor material 36 will come in contact with other parts of the image forming apparatus 10, such as the printhead 500. Such contact can cause a media jam and possible loss of the intended image, or even catastrophic damage to the image forming apparatus 10.

Second, the vacuum imaging drum axially extending flat 322 imparts a bending force to the ends of the colorant donor materials 36 as they are held onto the vacuum imaging drum 300 surface by vacuum from within the interior of the vacuum imaging drum. When the vacuum is turned off, the bending force on the colorant donor material 36 ceases and removal of the colorant donor material from the vacuum imaging drum is facilitated.

Figure 6A:
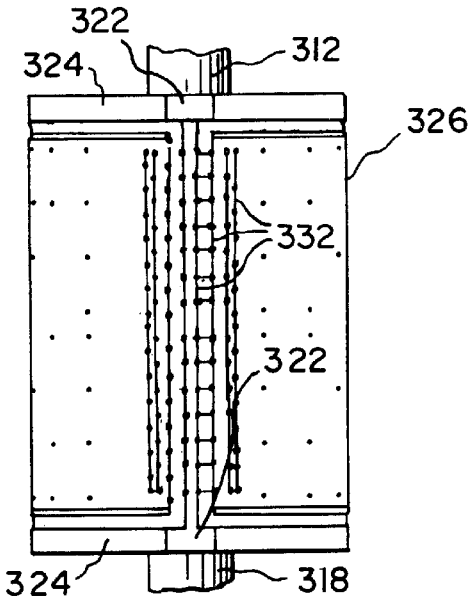
FIGS. 6*a*—6*c* are plan views of a vacuum imaging drum, showing the sequence of placement for thermal print media and colorant donor material.
Figure 6B:
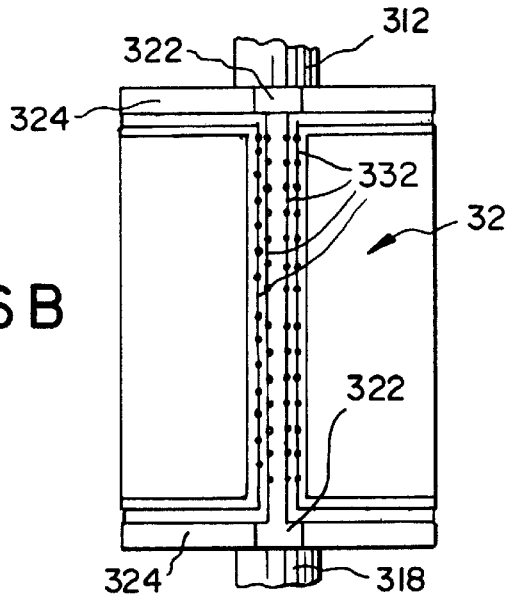
Figure 6C:
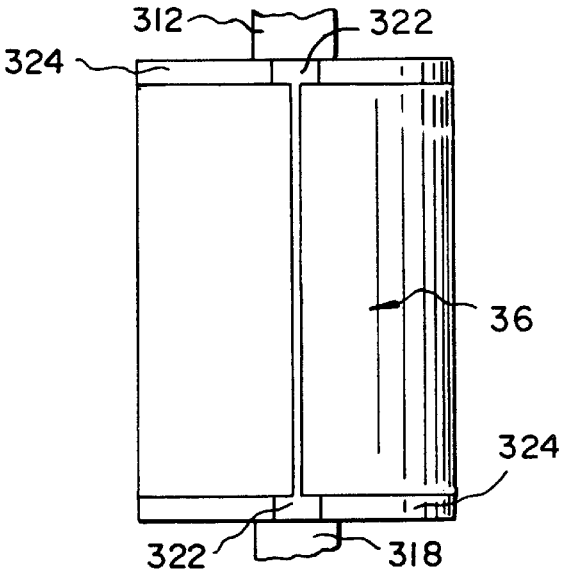

Referring to FIGS. 6*a* through 6*c*, the thermal print media 32 when mounted on the vacuum imaging drum is seated within the circumferential recess 326. Therefore, the donor support rings 324 have a thickness substantially equal to the thermal print media 32 thickness seated there between, which is approximately 0.004 inches (0.102 millimeters) in thickness.

The purpose of the circumferential recess 326 on the vacuum imaging drum 300 surface is to eliminate any creases in the colorant donor sheet material 36, as they are drawn down over the thermal print media 32 during the loading of the colorant donor sheet material 36. Such folds or creases could extend into the image area and seriously adversely affect the intended image. The circumferential recess 326 also substantially eliminates the entrapment of air along the edge of the thermal print media 32, where it is difficult for the vacuum holes 306 in the vacuum imaging drum 300 surface to assure the removal of the entrapped air. Residual air between the thermal print media 32 and the colorant donor sheet material 36 can also adversely affect the intended image.

Figure 7:
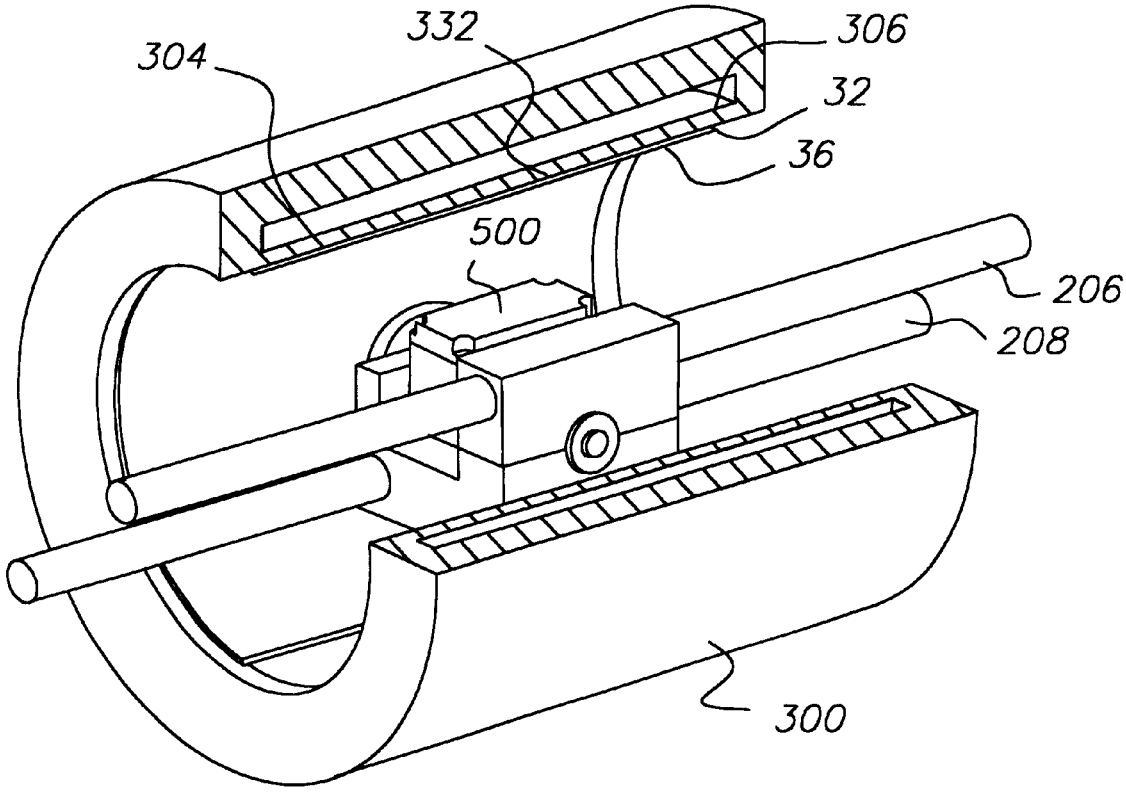
FIG. 7 is a perspective view of a printhead, imaging drum, and translation bearing rods according to the present invention.

Referring to FIG. 7, there is illustrated a vacuum imaging drum 300 with its hollowed-out interior portion 304 and vacuum holes 306. These extend through the vacuum drum housing 302 and allow a vacuum to be applied from the hollowed-out interior portion 304 of the vacuum imaging drum 300 for supporting and maintaining position of the thermal print media 32 and the colorant donor sheet material 36 as the vacuum imaging drum 300 rotates. The translation bearing rods 206, 208 are arranged parallel with axis X of the imaging drum 300, with the axis of the printhead 500 perpendicular to the axis X of the imaging drum 300. The two translation bearing rods 206, 208 form a parallel plane to each other and are as exactly parallel to the longitudinal axis of the imaging drum 300, and the lead screw axis, as is feasible. In an alternate embodiment, the rear translation bearing rod may lie at a 90 degree orientation to the front translation bearing rod (not shown). The printhead 500 is movable with respect to the imaging drum 300, and is arranged to direct a beam of light to the colorant donor sheet material 36. In use, the printhead 500 begins at one end of the thermal print media 32 and traverses the entire length of the thermal print media 32 for completing the transfer process for the particular colorant donor sheet material 36 resting on the thermal print media 32.

Figure 8:
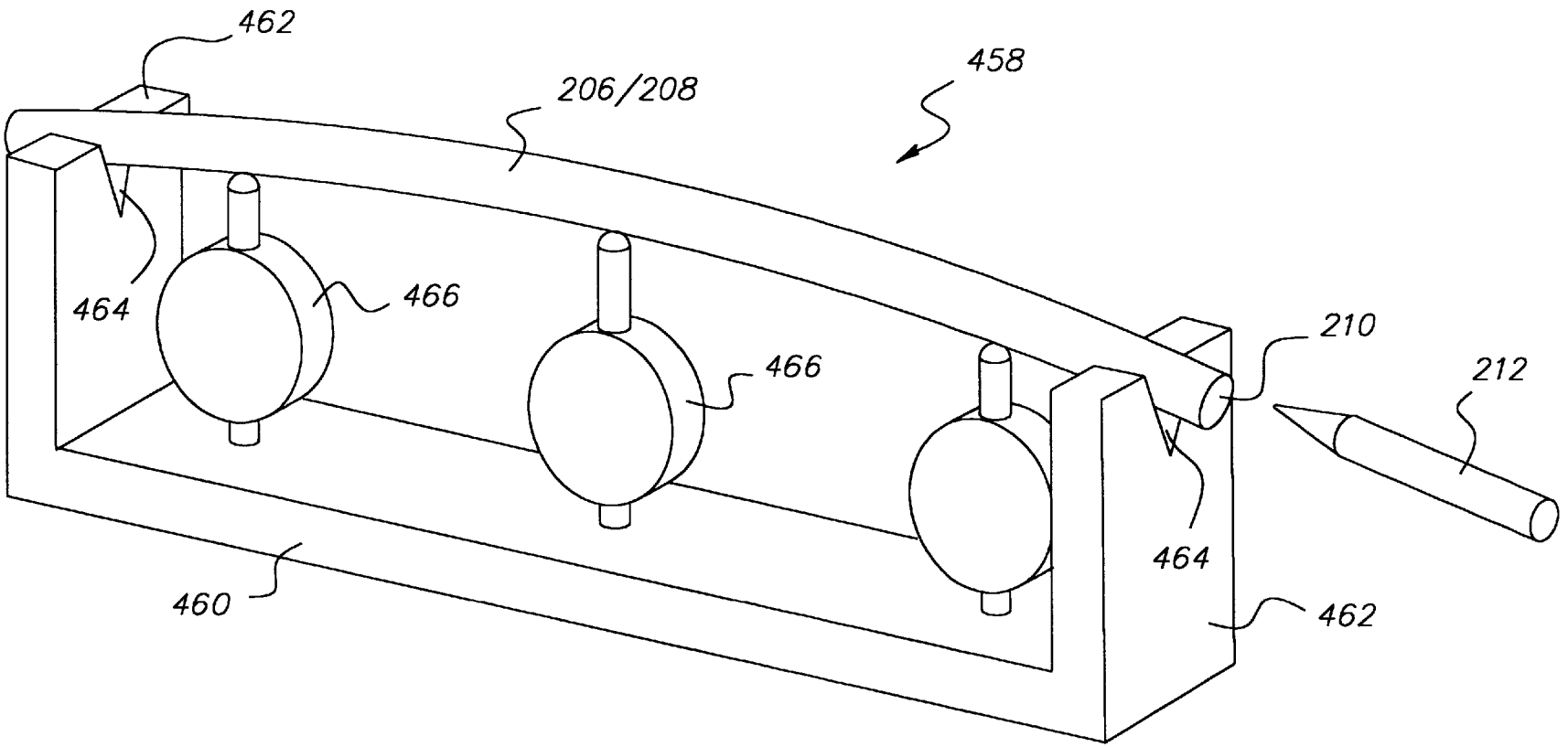
FIG. 8 is a perspective view of a bearing rod holder according to the present invention.

Referring to FIG. 8, there is illustrated a translation bearing rod 208 as used in a lathe bed scanning subsystem of the present invention. The imaging apparatus of the present invention may have one translation bearing rod, though it preferably has two, as described herein. Either the front translation bearing rod alone, or both the front and rear translation bearing rods, can be aligned as described herein. This is done so that the translation bearing rods can be mounted and oriented to minimize any error due to the lack of straightness of the translation, positional tolerances in the manufacture of the lathe bed scanning frame, and any errors in the imaging drum, such as runout or tapper.

Continuing with FIG. 8, each translation bearing rod 206/208 is suspended in a bearing rod holder 458 for facilitating measurement of any defect in the translation bearing rod. The bearing rod holder comprises:

(a) a longitudinally extending bearing rod center segment 460 beneath and parallel to the translation bearing rod 206/208, (b) two upwardly extending bearing rod arm members 462, which are affixed to each end of the center segment 460 at an approximate right angle to the center segment; and (c) a measurement mechanism for quantifying any arc or defect in the translation bearing rod.

The translation bearing rods are freely rotatable in the bearing rod holder. Each end of the translation bearing rod is mounted in a notch 464 in the ends of each of the arm members. The notch 464 is preferably a V-shaped notch in the center of the end of the arm member. The measurement mechanism is preferably two to four, most preferably three, dial indicator measuring devices 466, each extending upwardly from the center segment between the arm members. Each of the dial indicator measuring devices 466 has a bottom end attached to the center segment and an opposite, top end adjacent to a bottom side of the translation bearing rod. The dial indicator measuring devices are capable of quantifying any misalignment of the translation bearing rod. They ordinarily measure the distance from the center segment relative to the V-shaped notches. Once the translation bearing rod 206/208 is measured for straightness, an alignment mark 210 is placed on one end of the rod with a prick punch, crayon 212, or any suitable instrument, as shown in FIG. 8. The mark indicates to the technician/user where the bow, or arc, in the rod is.

Figure 9:
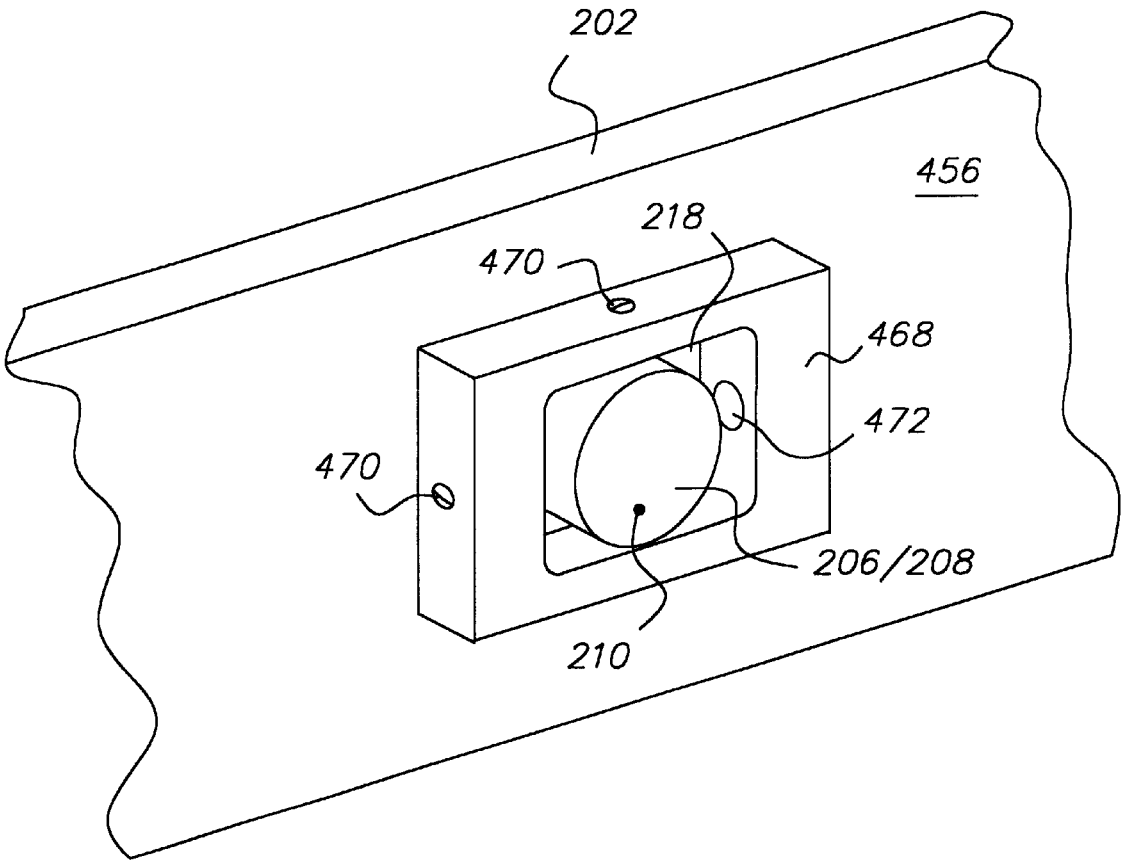
FIG. 9 is a perspective view of a translation bearing rod in a rod bore frame according to the present invention.

Referring to FIG. 9, each of the rod support bores 218 at either end of the translation bearing rod 206/208 in the lathe bed scanning frame 202 is surrounded by a rod bore frame 468. The rod bore frame 468 is mounted on the outside wall 456 of the lathe bed scanning frame 202. The translation bearing rod end extends through the rod support bore and frame. Where there are two translation bearing rods, the apparatus would have four such rod bores with frames, one for each end of the two rods. Each rod bore frame comprises screw apertures through which adjustment screws 470 and set screws 472 extend. The adjustment screws 470 are adapted for adjusting alignment of the translation bearing rod, and the set screws 472 are adapted for fixing the translation bearing rod in place once it has been aligned. The adjustment mechanism for adjusting and locking the translation bearing rods 206 and 208 is preferably provided by two adjustment screws 470 and one set screw 472 for each rod, as shown in FIG. 9. In use, the technician/user marks the translation bearing rod, and adjusts the bearing rod in or out in the rod bore so that the straightest portion of the rod is parallel to the imaging drum. The technician then locks the rod in place using the set screws. In this manner, each imaging apparatus can be customized to work optimally, despite the particular defect in the translation bearing rod or rods in that apparatus. This way of compensating for manufacturing defects in the translation bearing rod or rods is surprisingly effective in reducing required maintenance and costs for the image forming apparatus, eliminating the need to automatically focus the printhead, increasing image quality, adding margin for depth of focus, and handling a larger range of media thickness tolerance.

Figure 10:
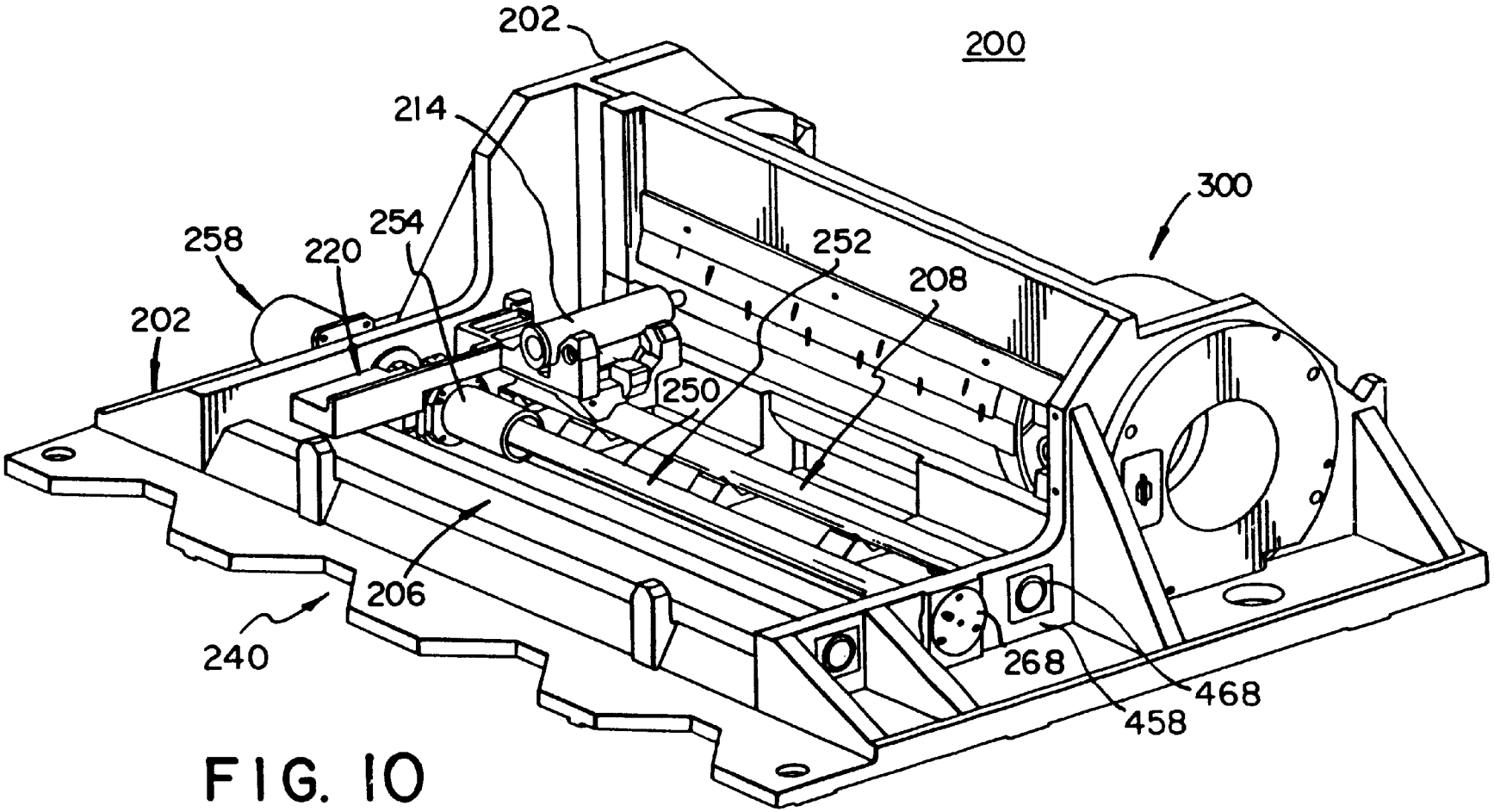
FIG. 10 is a perspective view of a linear translation subsystem and imaging drum according to the present invention, with a capacitance probe mounted in place of a printhead.

In FIG. 10, a linear translation subsystem 240 and imaging drum 300 are illustrated, with a capacitance probe 214 mounted in place of a printhead. The capacitance probe 214, which is mounted in a probe holder, replicates the printhead 500, which is mounted on the translation stage member 220. With the capacitance probe 214 mounted in place of the printhead, the thermal print media 32 and colorant donor sheet material 36 are mounted onto the imaging drum 300. The imaging drum 300 is then rotated at the same speed as would be used to write an intended image ("writing speed"). The linear translation subsystem 240 then moves the translation stage 220 along the imaging drum 300 while the capacitance probe 214 measures the distance or gap between the capacitance probe 214 and the imaging drum 300. This would be the same as the distance or gap between the printhead 500 and the imaging drum 300, and would show any misalignment of the linear translation subsystem 240 to the vacuum imaging drum 300. Using the adjustment screws 470 and the data provided by the capacitance probe 214, the misalignment of the linear translation subsystem 240 is then removed or minimized by adjusting the translation bearing rods 206 and 208. After the translation bearing rods 206 and 208 are positioned, they are locked in place by the set screws 472. The capacitance probe 214 mounted in the probe holder is then removed and the printhead 500 installed. The above mentioned procedure removes or minimizes any misalignment errors of the linear translation subsystem 240 and printhead 500 to the vacuum imaging 300, thermal print media 32 and colorant donor sheet material 36. This optimizes system performance and output image quality of the image forming apparatus 10.

The image forming apparatus herein can be, for example, a laser thermal printer, ink-jet printer, color proofer, laser thermal plate writer, or a laser thermal film writer.

A process for minimizing misalignment of a linear translation subsystem 240 of an image forming apparatus 10 is also included in the present invention. The process comprises the following steps:

a) temporarily replacing a printhead 500 with a capacitance probe 214 mounted in a probe holder (for acting as a printhead barrel);

b) mounting sheet print media 32 and colorant donor material 36 on an imaging drum 300;

c) rotating the imaging drum 300 at writing speed;

d) allowing a linear translation subsystem 240 to move a translation stage member 220 along the imaging drum 300;

e) using the capacitance probe 214 to measure a distance, or gap, between the capacitance probe and the imaging drum;

f) adjusting any misalignment of the linear translation subsystem 240 to the imaging drum surface, and preferably the print media 32, and colorant donor material 36, by rotating adjustment screws 470 at either end of one or more, preferably two, translation bearing rods 206/208 in the linear translation subsystem 240;

g) locking the translation bearing rod 208 in place, preferably using set screws 472 at both ends of the translation bearing rod;

h) removing the capacitance probe 214; and i) reinstalling the printhead 500.

With the capacitance probe 214 mounted in place of the printhead 500, the print media 32, preferably thermal print media, and colorant donor material 36 are mounted on the imaging drum 300 and the imaging drum is rotated at writing speed. The linear translation subsystem 240 moves the translation stage member 220 along the imaging drum 300 while the capacitance probe 214 measures the distance, or gap, between the capacitance probe and the vacuum imaging drum. This is the same as the gap between the printhead 500 and the imaging drum 300, and shows any misalignment of the linear translation subsystem to the imaging drum surface, print media, and colorant donor material.

The process preferably includes a first step of measuring and locating the straightest line along the translation bearing rod 208, and marking the point 210 indicating the end of this line at one end of the translation bearing rod 208. Preferably, the adjusting step comprises rotating the translation bearing rod 208 to align the straightest line (or side) along the translation bearing rod so that the straightest side is perpendicular to the linear motion of the capacitance probe 214, or the printhead when the printhead 500 is in place. In other words, any arc, or bow, in the translation bearing rod should be placed above (preferred) or below the imaging drum so that its effect is minimized. This is done so that the distribution of the printhead 500 to the imaging drum 300 has the least amount of error. It is preferably accomplished by rotating adjustment screws 470 at either end of the translation bearing rod. The locking step preferably comprises rotating set screws 472 at either end of the translation bearing rod 208. After locking the translation bearing rods 206/208 in place, the capacitance probe 214 is removed, and the printhead 500 is installed. Any misalignment is reduced or removed using the adjustment screws 470. This adjustment procedure removes or minimizes any misalignment of the linear translation subsystem, and therefore between the printhead and the imaging drum. Thus, system performance and output image quality of the image forming apparatus 10 are optimized.

The invention has been described with reference to the preferred embodiment thereof. However, it will be appreciated and understood that variations and modifications can be effected within the spirit and scope of the invention as described herein above and as defined in the appended claims by a person of ordinary skill in the art without departing from the scope of the invention. It is intended that the doctrine of equivalents be relied upon to determine the fair scope of these claims in connection with any other person's product that falls outside the literal wording of these claims, but which in reality does not materially depart from this invention.

For example, it would be obvious to a person skilled in the art that this invention could be used in other applications, such as an ink-jet image forming apparatus, plate image forming apparatus, film image forming apparatus or any image forming apparatus with an external drum, internal drum or platen using any material for forming an intended image therein. Also, the colorant donor may have dye, pigments, or other material which are transferred to the print media. The term "thermal print media" includes paper, films, plates, and other material capable of accepting or producing an image.

PARTS LIST

10. Image forming apparatus
12. Image processor housing
14. Image processor door
16. Donor ejection chute
18. Donor waste bin
20. Media stop
30. Roll media
32. Print media
34. Colorant donor roll material
36. Colorant donor material
50. Sheet material trays
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
180. Color binding assembly
182. Media entrance door
184. Media exit door
200. Lathe bed scanning subsystem
202. Lathe bed scanning frame
204. Entrance passageway
206. Rear translation bearing rod
208. Front translation bearing rod
210. Alignment mark
212. Prick punch
214. Capacitance probe
218. Rod support bores
220. Translation stage member
222. Vacuum fitting
224. Vacuum blower
240. Linear translation subsystem
250. Lead screw
252. Threaded shaft
254. Lead screw drive nut
256. Drive coupling
258. Linear drive motor
260. Axial load magnets
260*a*. Axial load magnet
260*b*. Axial load magnet
262. Circular-shaped boss
264. Ball bearing
266. Circular-shaped insert
268. End cap
270. Hollowed-out center portion
272. Radial bearing
300. Vacuum imaging drum
301. Axis of rotation
302. Vacuum drum housing
304. Hollowed out interior portion
306. Vacuum hole
308. Vacuum end plate
310. Drive end plate
312. Drive spindle
314. Support bearing
318. Vacuum spindle
320. Central vacuum opening
322. Axially extending flat
324. Donor support ring
326. Circumferential recess
332. Vacuum grooves
400. Laser assembly
402. Laser
404. Fiber-optic cables
406. Distribution block
450. Writing swath
454. Optical centerline
456. Lathe bed scanning frame outside wall
458. Bearing rod holder
460. Bearing rod holder center segment
462. Bearing rod holder arm members
464. Arm member notch
466. Dial indicator measuring device
468. Rod bore frame
470. Adjustment screw
472. Set screw
500. Printhead

What is claimed is:

1. An image forming apparatus for writing images to a print media, comprising:

a) a rotatable imaging drum comprising a drum housing;

b) a motor capable of rotating said imaging drum;

c) sheet print media mounted on said imaging drum;

d) a printhead adapted for forming said image, said printhead being movable along a line parallel to a longitudinal axis of said imaging drum as said imaging drum rotates; and e) a linear translation subsystem for moving said printhead, said linear translation subsystem comprising one or two adjustable translation bearing rods, said translation bearing rod being parallel to said longitudinal axis of said imaging drum, said printhead being supported on said translation bearing rod, said translation bearing rod being adjustable for minimizing misalignment error between said linear translation subsystem and said imaging drum.

2. An image forming apparatus according to claim 1 wherein said printhead, said imaging drum, and said linear translation subsystem are mounted on a lathe bed scanning frame.

3. An image forming apparatus according to claim 2 wherein said print media is thermal print media.

4. An image forming apparatus according to claim 3 wherein said rotatable imaging drum is a vacuum imaging drum adapted for receiving and holding a sheet of colorant donor material and a sheet of thermal print media, said thermal print media is covered by said colorant donor material, and said drum housing is generally cylindrically shaped.

5. An image forming apparatus according to claim 4 wherein a colorant donor material overlays said thermal print media, and said printhead writes an image to said thermal print media by transferring a color from said colorant donor material to said thermal print media.

6. An image forming apparatus according to claim 3 wherein said image forming apparatus is a laser thermal printer.

7. An image forming apparatus according to claim 6 wherein said hollow interior imaging drum is a vacuum imaging drum mounted for rotation about its axis and arranged to mount said thermal print media and said colorant donor material in superimposed relationship thereon, said thermal print media having a first length and width and said colorant donor material having a second length and width greater than those of said thermal print media, and said vacuum imaging drum having a first set of thermal print media vacuum holes and a second set of colorant donor material vacuum holes, said vacuum holes extending from an interior of said vacuum drum to a surface of said vacuum imaging drum.

8. An image forming apparatus according to claim 6 further comprising: means for providing vacuum to said interior of said vacuum imaging drum; an axially extending flat disposed in said surface of said vacuum imaging drum and arranged to accept a leading and a trailing edge of said colorant donor material; and a thermal print media-receiving circumferential recess on said surface of said vacuum imaging drum formed by donor support rings in said vacuum imaging drum; wherein said vacuum imaging drum diameter and a width of said axially extending flat are arranged such that said leading and trailing edges of said colorant donor material overlie opposite edges of said axially extending flat without overlapping each other.

9. An image forming apparatus according to claim 2 further comprising rod support bores in said lathe bed scanning frame for each of said translation bearing rods, said rod support bores supporting opposite ends of said translation bearing rods.

10. An image forming apparatus according to claim 9 further comprising an axially extending flat extending over a portion of said vacuum imaging drum, and a circumferential recess extending from a side of said axially extending flat circumferentially around said vacuum imaging drum to a second side of said axially extending flat.

11. An image forming apparatus according to claim 9 wherein said rod support bores comprise notches at one or both ends of said translation bearing rod adapted for allowing adjustment of said translation bearing rods to compensate for defects in said translation bearing rod.

12. An image forming apparatus according to claim 9 further comprising an adjustment mechanism adapted for adjusting alignment of said translation bearing rod in relation to said imaging drum and locking said translation bearing rod in place.

13. An image forming apparatus according to claim 12 further comprising a movable translation stage member, said printhead being mounted on said translation stage member, said translation stage member and said printhead being supported on two of said translation bearing rods, a rear one of said translation bearing rods being either parallel or perpendicular to a front one of said translation bearing rods, said front translation bearing rod being parallel to said longitudinal axis of said imaging drum.

14. An image forming apparatus according to claim 13 wherein said adjustment mechanism comprises at least one adjustment screw and at least one set screw at each end of each of said translation bearing rods.

15. An image forming apparatus according to claim 9 wherein each of said rod support bores at either end of said translation bearing rod in said lathe bed scanning frame is surrounded by a rod bore frame, said rod bore frame being mounted on an outside wall of said lathe bed scanning frame, said translation bearing rod ends extending through said rod support bores and said rod bore frames, said rod bore frames comprising screw apertures through which extend adjustment screws and set screws, said adjustment screws being adapted for adjusting alignment of said translation bearing rod, and said set screws being adapted for fixing said translation bearing rod in place once it has been aligned.

16. An image forming apparatus according to claim 15 wherein said thermal print media is covered by a colorant donor material.

17. An image forming apparatus according to claim 16 wherein said imaging drum is a vacuum imaging drum comprising at least one vacuum hole and at least one vacuum groove in said drum housing.

18. An image forming apparatus according to claim 16 wherein a plurality of laser diodes within a laser assembly is connected to said printhead by a plurality of fiber-optic cables adapted for the production of light.

19. An image forming apparatus according to claim 1 wherein said image forming apparatus is an ink-jet printer.

20. An image forming apparatus according to claim 1 wherein said image forming apparatus is a laser thermal plate writer or a laser thermal film writer.

21. A bearing rod holder for facilitating measurement of any defect in a translation bearing rod, the bearing rod holder comprising:

(a) a longitudinally extending center segment beneath and parallel to said translation bearing rod, and (b) two upwardly extending arm members, which are affixed to each end of said center segment at a right angle to said center segment, each end of said translation bearing rod being mounted in a notch in the ends of each of said arm members; and (c) a measurement mechanism for quantifying any arc or defect in the translation bearing rod;

wherein said translation bearing rod is rotatable in said bearing rod holder.

22. A bearing rod holder according to claim 21 wherein said measurement mechanism comprises between two and four dial indicator measuring devices, each extending upwardly from said center segment between said arm members, each of said dial indicator measuring devices having a bottom end attached to a top face of said center segment and an opposite, top end adjacent to a bottom side of said translation bearing rod, said dial indicator measuring devices being capable of quantifying any misalignment of said translation bearing rod.

23. A process for minimizing misalignment of a linear translation subsystem of an image forming apparatus, the process comprising the steps of:

a) temporarily replacing a printhead with a capacitance probe mounted in a probe holder;

b) mounting sheet print media and colorant donor material on an imaging drum;

c) rotating said imaging drum at writing speed;

d) allowing a linear translation subsystem to move a translation stage member along said imaging drum;

e) using said capacitance probe to measure a distance, or gap, between said capacitance probe and the surface of said imaging drum;

f) adjusting any misalignment of said linear translation subsystem to said imaging drum surface by moving one or more translation bearing rods in said linear translation subsystem;

g) locking said translation bearing rod in place;

h) removing said capacitance probe with its probe holder; and i) reinstalling said printhead.

24. An image forming apparatus according to claim 23 further comprising a first step of measuring said translation bearing rod, locating the straightest line along said translation bearing rod, and marking a point indicating said straightest line at an end of said translation bearing rod.

25. An image forming apparatus according to claim 24 wherein said adjusting step comprises adjusting said translation bearing rod to align said straightest line along said translation bearing rod perpendicular to the linear axis of motion of said capacitance probe by rotating adjustment screws at one or both ends of said translation bearing rod; and said locking step comprises rotating set screws at both ends of said translation bearing rod.

* * * * *